US006848845B2

(12) United States Patent
Poole

(10) Patent No.: US 6,848,845 B2
(45) Date of Patent: Feb. 1, 2005

(54) THERMAL RIBBON CARTRIDGE OR ROLL WITH SLACK RIBBON RETRACTION

(75) Inventor: David L. Poole, Palatine, IL (US)

(73) Assignee: ZIH Corp., Hamilton (BM)

( * ) Notice: Subject to any disclaimer, the term of this patent is extended or adjusted under 35 U.S.C. 154(b) by 0 days.

(21) Appl. No.: 10/141,322

(22) Filed: May 8, 2002

(65) Prior Publication Data

US 2003/0210941 A1 Nov. 13, 2003

(51) Int. Cl.[7] ..... B41J 35/28
(52) U.S. Cl. ..... 400/207; 400/234
(58) Field of Search ..... 400/207, 208, 400/218, 222, 223, 234, 208.1, 225, 242, 244, 247

(56) References Cited

U.S. PATENT DOCUMENTS

| | | | | | |
|---|---|---|---|---|---|
| 4,625,931 | A | * | 12/1986 | Tamura et al. | 242/423.1 |
| 4,773,775 | A | | 9/1988 | Bradshaw et al. | 400/208 |
| 4,838,716 | A | | 6/1989 | Shinada | 400/208 |
| 4,886,384 | A | | 12/1989 | Harry | 324/244 |
| 5,170,956 | A | * | 12/1992 | McTaggart | 242/422.4 |
| 5,284,396 | A | | 2/1994 | Masumura et al. | 400/234 |
| 5,297,750 | A | * | 3/1994 | Hunt | 242/422.4 |
| 5,297,879 | A | | 3/1994 | Oikawa | 400/234 |
| 5,443,319 | A | * | 8/1995 | Sugiura et al. | 400/250 |
| 5,595,447 | A | | 1/1997 | Takayama et al. | 400/231 |
| 5,772,341 | A | * | 6/1998 | Hamisch et al. | 400/234 |
| 5,788,387 | A | | 8/1998 | Takayama et al. | 400/586 |
| 5,938,350 | A | * | 8/1999 | Colonel | 400/234 |
| 6,126,344 | A | | 10/2000 | Takayama et al. | 400/615.2 |
| 6,129,463 | A | | 10/2000 | Lau et al. | 400/234 |
| 6,130,699 | A | | 10/2000 | Christensen et al. | 347/218 |
| RE36,953 | E | * | 11/2000 | Lodwig et al. | 400/234 |
| 6,142,686 | A | * | 11/2000 | Schanke et al. | 400/234 |
| 6,231,253 | B1 | | 5/2001 | Henderson et al. | 400/618 |
| 6,307,583 | B1 | | 10/2001 | Randolph et al. | 347/217 |

FOREIGN PATENT DOCUMENTS

| | | |
|---|---|---|
| EP | 0 165 396 A2 | 12/1985 |
| EP | 0 408 356 B1 | 6/1994 |

OTHER PUBLICATIONS

Internal Solutions for Wed Designers and Builders Professional—Structuring XML Documents by Richard V. Dragan, Article from Website http://www.pcmag.com.

* cited by examiner

*Primary Examiner*—Anthony H. Nguyen
(74) *Attorney, Agent, or Firm*—Welsh & Katz, Ltd.

(57) ABSTRACT

A ribbon cartridge for a thermal transfer printer is configured to provide a retractable feed for a donor ribbon. The ribbon cartridge includes a housing, a roll of donor ribbon wound on a core within the housing, and a clutch operatively coupled to the core. A resilient structure is coupled to the clutch and to the cartridge housing such that the release of energy stored in the resilient structure by advance of the donor ribbon produces retraction of ribbon slack, if the donor ribbon is released or backfed. Alternatively, a ribbon roll having a self-contained clutching and slack take-up capability includes a hollow core configured to receive a roll of ribbon and a clutch having a friction component configured to induce frictional engagement with the core. At least one end of the clutch is adapted to be externally constrained, and a resilient component is located between the friction component and at least one end of the clutch.

14 Claims, 4 Drawing Sheets

THERMAL RIBBON CARTRIDGE OR ROLL WITH SLACK RIBBON RETRACTION

FIELD OF THE INVENTION

The present invention relates to thermal transfer printers and more specifically to a ribbon cartridge or roll for a thermal transfer printer, which automatically retracts ribbon slack resulting from backfeed.

BACKGROUND OF THE INVENTION

Thermal transfer printers are well known in the art. In such printers, a transfer ribbon coated on one side with a heat-transferable ink layer is interposed between the surface of a non-sensitized web and a thermal print head having a line of small heater elements. When an electrical signal or pulse is applied to a selected subset of the heater elements, localized melting and transfer of the ink to the web occurs, resulting in a corresponding line of dots being transferred. The web is then advanced to print an adjacent location, and the transfer ribbon is repositioned to provide a replenished ink coating. The selecting and heating process is repeated to print an adjacent line of dots. Patterns of successive dots produce printed text or graphics on the web.

Thermal transfer printers are particularly well suited to printing a web of individual tags, tickets, and labels. In such printers, the web is advanced past the print head so the trailing edge of a tag, ticket, or label extends beyond a mechanical cutter or tear-off edge. To reduce waste, it is preferable to backfeed the web before printing again. This results in a corresponding backfeed of the transfer ribbon and the potential for slack ribbon. If slack ribbon is allowed to remain, the resulting loss of ribbon tension may cause the ribbon to wrinkle upon advance, with a resulting loss of print quality. To prevent this, known thermal label ticket and tag printers are typically equipped with a spindle for the ribbon supply roll having a torsion spring and clutch. Forward advancement of the ribbon winds the spring until the spring force overcomes the clutch force, at which point the ribbon feeds at a desired tension determined by the clutch torque.

If a thermal transfer printer according to the prior art must further be capable of printing a range of label, ticket, or tag widths, then the ribbon tension will vary with ribbon width, and no single setting of clutch torque may suffice. The ribbon may wrinkle if the tension is set too low to accommodate a narrower ribbon than is being used, and it may slip if it is set too high to accommodate a wider ribbon than is being used. To address this, the ribbon supply spindle may be equipped with user or technician adjustment for spindle torque. Alternatively, the ribbon supply spindle can be segmented and may have a separate spring and clutch for each segment, such that wider ribbons will engage progressively higher torque segments to maintain relatively constant ribbon tension. Such measures and the cost of frictional components that will last the life of the printer contribute significantly to the cost of the printer.

European Patent Application 0 408 356 A2 to Inoue teaches a ribbon supply core that is reversely rotated to prevent slack. However, the mechanism is reverse driven by the printer rather than operating on elastically stored energy, and it is connected to the printer frame rather than being part of a ribbon cartridge.

U.S. Pat. No. 5,284,396 to Masamura, et. al. teaches two embodiments of a ribbon supply spindle in which energy is stored in an extension spring or torsion spring. In the preferred embodiment, energy is stored in an extension spring and the resulting torque is transferred to a rotatable shaft on which a ribbon supply spool is fixedly mounted. In the alternate embodiment, the shaft is fixed and a ribbon supply spool is rotatably mounted and made nonremovable by a collar, which bears upon a clutch plate and torsion spring, which provides the stored energy. In both embodiments, however, the spring and clutch are part of the printer mechanism, and therefore require operator torque adjustment to accommodate a range of ribbon widths. Moreover, such components must be made of material suitable to the useful life of the printer rather than the useful life of the ribbon.

European Patent Application 0 165 396 to Kitagishi teaches a ribbon cassette with a constant tension imparting mechanism consisting of friction members that are compressed by a plate spring and which sandwich the ribbon. The spring provides frictional force rather than storing energy, and is "H-shaped" to specifically prevent it from doing so, thereby producing equal drag in both directions of ribbon movement. Thus, if the ribbon according to Kitagishi is advanced then released with slack, the slack will remain.

U.S. Pat. Nos. 6,126,344 and 5,788,387 and 5,595,447 to Takayama et al. teach a tape cartridge and printing device having an anti-slack mechanism for preventing slack of the ink ribbon through engagement of a ribbon winding core with an anti-rotational engagement piece. This mechanism, however is intentionally disengaged when the cartridge is set in the printing device rather than being intended to work during printing.

U.S. Pat. No. 4,838,716 to Shinada teaches a ribbon cartridge having a brake mechanism for preventing unnecessary rotation of the feeding ribbon roll. A spring is used to urge a takeup roller against a driven roller so as to pull ribbon from the supply. However, Shinada does not teach or suggest a mechanism to store energy in the supply cartridge or roll and retract slack ribbon into the cartridge or onto the roll.

SUMMARY OF THE INVENTION

The present invention provides a thermal transfer ribbon cartridge and alternatively a ribbon roll capable of supplying ribbon and maintaining a minimum ribbon tension by retracting a limited amount of ribbon slack. Further, in accordance with the present invention, there is provided a thermal transfer printer having passive support means for the cooperating ribbon cartridge in lieu of a ribbon spindle.

DESCRIPTION OF THE DRAWINGS

The accompanying drawings illustrate preferred embodiments of the invention to facilitate a thorough understanding of it. The invention includes certain novel features and structural details hereinafter fully described and particularly pointed out in the appended claims, it being understood that various changes in the details may be made without departing from the spirit, or sacrificing any of the advantages of the present invention.

DETAILED DESCRIPTION

Figure 1:
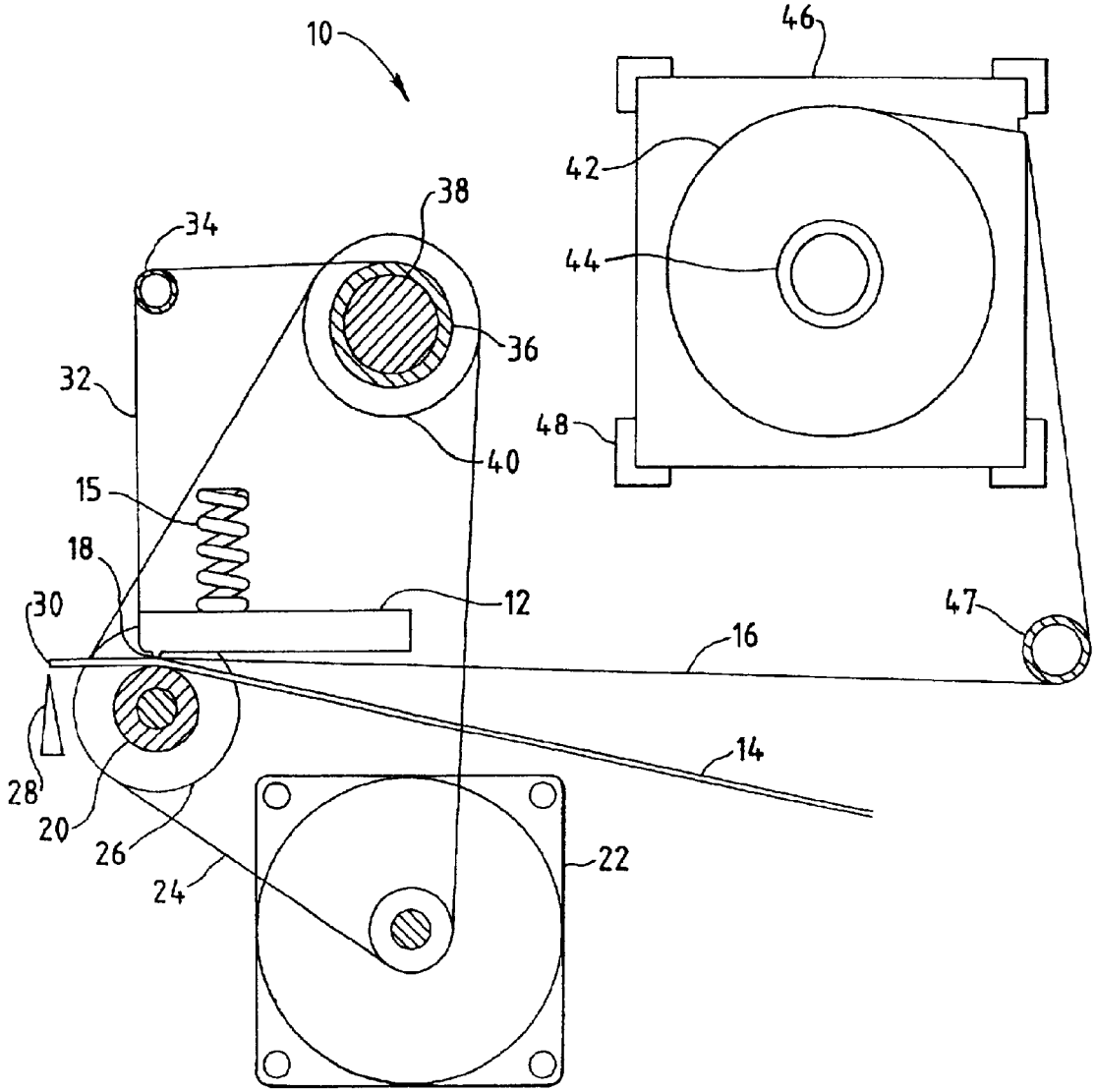
FIG. 1 is a side elevation view of a specific embodiment of thermal transfer printer provided by the present invention showing a transfer ribbon cartridge adapted to cooperate with the printer in advancing the transfer ribbon and maintaining constant ribbon tension.

Referring to the drawings, FIG. 1 is a pictorial representation of a thermal transfer printer 10. Thermal transfer printer 10 includes a thermal print head 12 for printing images on a web 14, such as a roll of pressure sensitive labels, tickets, or tags, by transferring ink from a transfer ribbon 16 to web 14 at print line 18. Web 14 is advanced by a platen 20, which carries transfer ribbon 16 along with it due to the frictional contact with web 14 at print line 18 under pressure of spring 15. Platen 20 is driven by a stepper motor 22 through a belt 24 and a drive pulley 26. After printing a label, ticket, or tag, web 14 is advanced to a cutting edge 28 where the label, ticket, or tag can be torn off by the user. The torn edge 30 is then retracted before printing the next label, ticket, or tag.

Spent transfer ribbon 32 passes from print line 18 via a guide 34 to a takeup core 36 removably positioned on a takeup spindle 38. Takeup spindle 38 is driven by belt 24 through a pulley 40 and a clutch (not shown), which limits the takeup torque to avoid breaking the ribbon.

Transfer ribbon 16 is fed from ribbon roll 42, which is wound on core 44 and contained within a ribbon cartridge 46, passing around guide 47 to print line 18. Thermal printer 10 is adapted to receive and support ribbon cartridge 46 on shelf 48. Cartridge 46 includes certain novel features and structural details further illustrated in FIG. 2 and described below.

Figure 2:
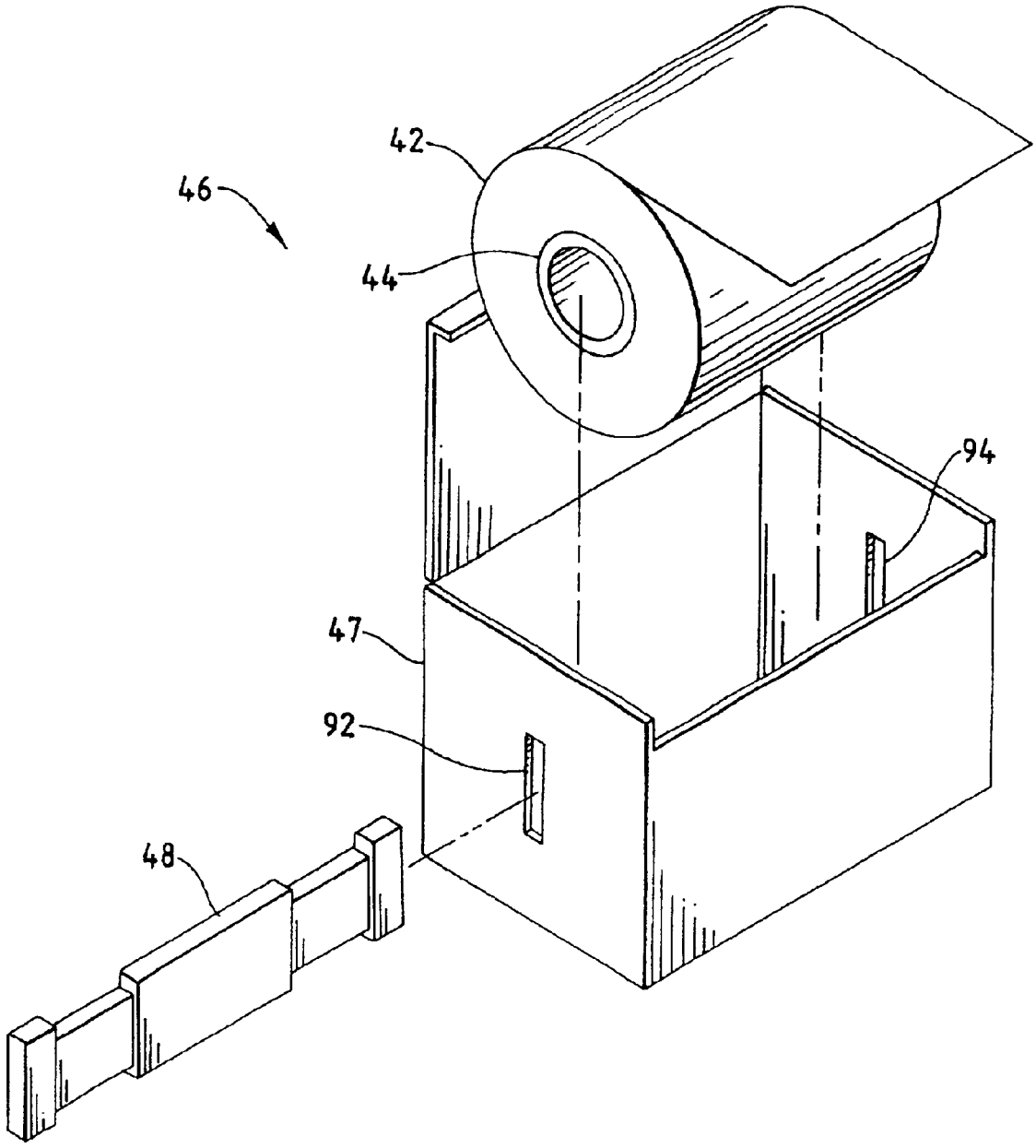
FIG. 2 is a perspective view of a specific embodiment of the cooperating ribbon cartridge according to the preferred embodiment.

With reference to FIG. 2, cartridge 46 includes a carton 47, preferably formed of cardboard or corrugated fiberboard, which encloses ribbon roll 42, wound on hollow core 44, and preferably formed of fiber or alternatively formed of plastic. Core 44 further encloses brake 48, formed of an elastomer, preferably urethane. Slots 92 and 94 in facing walls of carton 47 capture the ends of brake 48 and prevent its rotation.

Figure 3A:
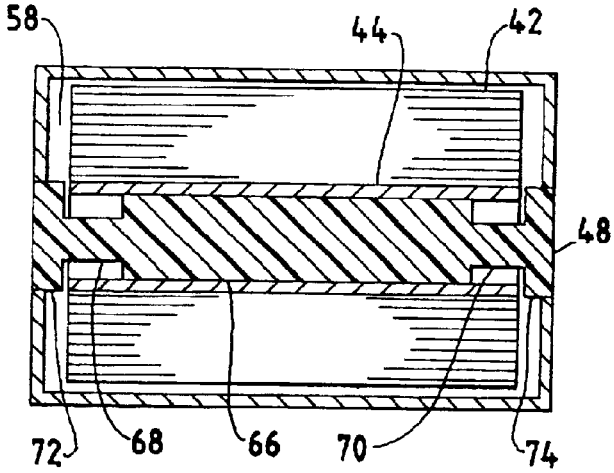
FIGS. 3*a* and 3*b* are sectional views of the cooperating ribbon cartridge according to the preferred embodiment.

With reference to FIG. 3*a*, brake 48 includes a clutch section 66, spring sections 68 and 70, and end sections 72 and 74. Clutch section 66 is dimensioned for an interference fit with core 44. The degree of interference and the durometer and thickness of brake 48 are chosen to define a desired drag torque on roll 42 at which core 44 will begin to slip against clutch section 66. Note that although drawn as rectangular in cross section to facilitate understanding, brake 48 and the corresponding slots 92 and 94 (not shown) may be, for example, non-rectangular in cross section while remaining within the scope of the invention.

Figure 3B:
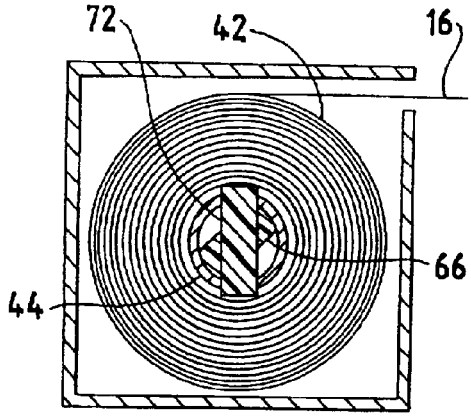

Spring sections 68 and 70 are typically of smaller cross section so as not to interfere with the rotation of core 44, but rather to twist elastically as indicated in FIG. 3*b*, thus permitting clutch section 66 to rotate until the drag torque is reached and clutch section 66 slips continuously against core 44 as ribbon 16 is withdrawn. The energy thus stored in spring sections 68 and 70 serve to retract slack when ribbon 16 is backfed. Depending on the characteristics of the elastomer, spring sections 68 and 70 may be, for example, notches or slits in brake 48.

Figure 4A:
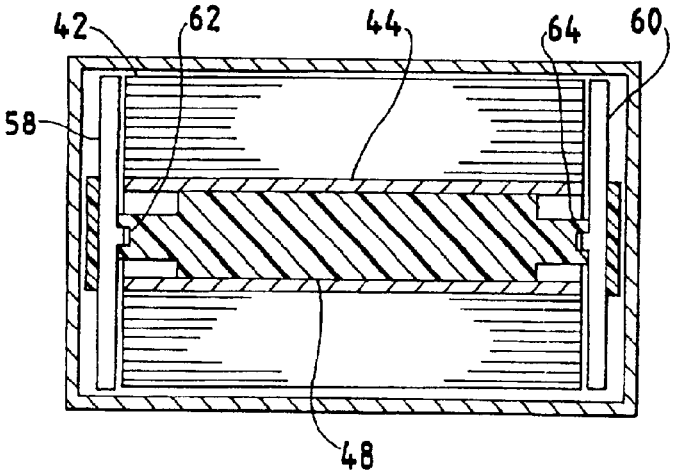
FIGS. 4*a* and 4*b* are sectional views of an alternate embodiment.
Figure 4B:
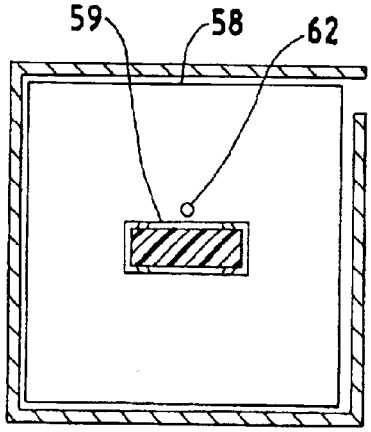

In the alternate embodiment of FIGS. 4*a* and 4*b*, brake 48 is rotated ninety degrees and inserts 58 and 60, preferably formed of thermoformed plastic, support the weight of roll 42 by means of protrusions 62 and 64 respectively protruding into core 44. If present, such supports 58 and 60 include slots 59 and 61 (not shown) to capture the ends of brake 48. Supports 58 and 60 may be used in addition to slots in the carton as previously described, or in the alternative.

Figure 5A:
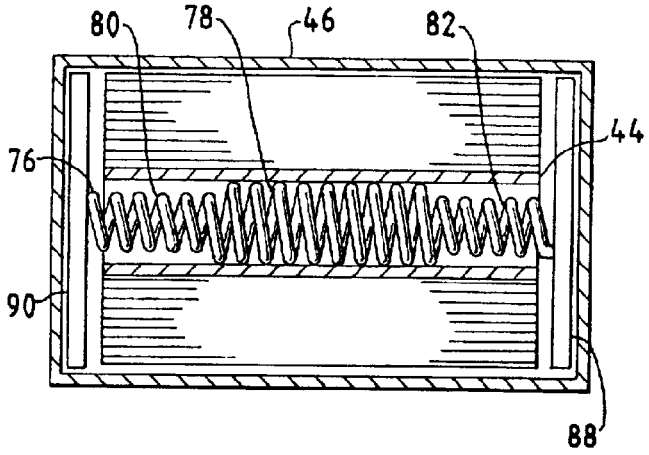
FIGS. 5*a* and 5*b* are sectional views of an alternate embodiment.
Figure 5B:
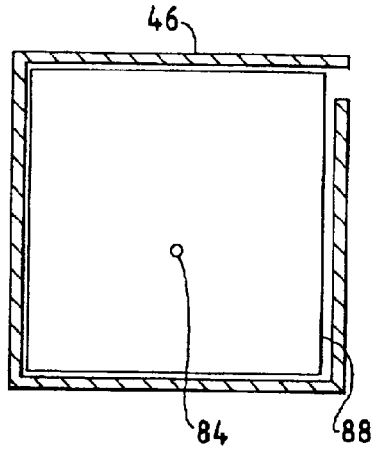

It is intended that brake 48 not be limited to an elastomeric material in order to lie within the scope of the invention. According to the alternate embodiment of FIGS. 5*a* and 5*b*, a multi-diametral (i.e., having more than one diameter) spring 76 has a clutch section 78 having an outer diameter chosen for an interference fit to core 44 and forming a spring clutch structure, and two torsion spring sections 80 and 82 of lesser diameter. Spring 76 is anchored to holes 84 and 86 (not shown) in inserts 88 and 90 that prevent its overall rotation. Alternatively, spring 76 may be anchored directly to holes in the facing walls of cartridge 46 in lieu of inserts at the loss of some ease of assembly.

Figure 6:
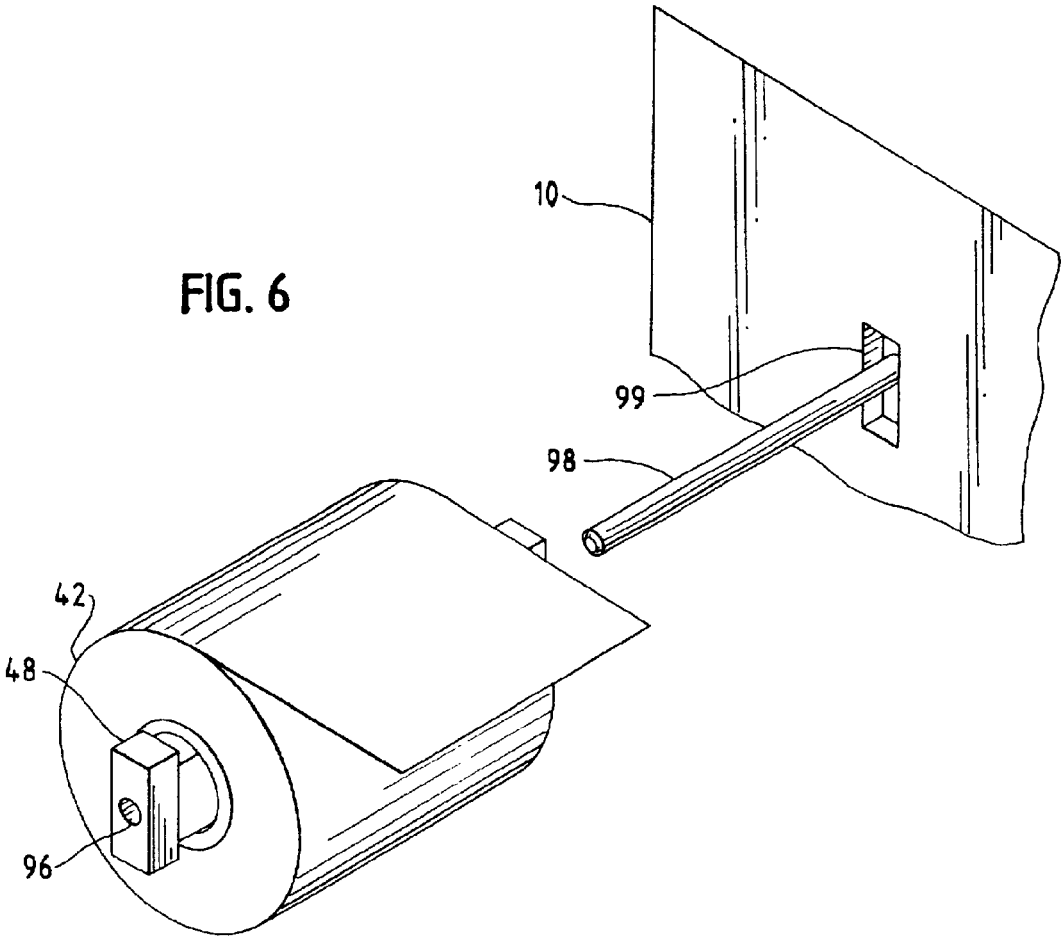
FIG. 6 is a perspective view of an alternate embodiment.

According to the alternate embodiment of FIG. 6, brake 48 further includes axial hole 96. Ribbon roll 42 is supported by a passive pin 98 fixed to printer 10. Brake 48 is captured and prevented from rotating by slot 99, also a part of printer 10.

It should be noted that brake 48 or the equivalent multi-diametral spring 76 is not limited to a single structure to lie within the scope of the invention, and that either may equivalently be comprised of individual parts performing the spring and clutch functions.

It should also be noted that the conditions of interference fit or free motion between the sections of the brake and the ribbon core can equivalently be met with a multi-diametral ribbon core and a brake of uniform dimensions, and that such structures lie within the intended scope of the invention.

Further, it should be noted that the ribbon can be wound on a core longer than the ribbon width, or the core as described can be fitted to an internal spindle and the clutch functionality coupled to the outside diameter of the core or spindle rather than to the inside diameter. While such embodiments may be more costly to manufacture, it is intended that they fall within the scope of the invention.

Cartridge 46 is intended to be disposable, hence core 44, and brake 48 or equivalently spring 76 can be dimensioned to provide the drag torque specific to the composition and width of ribbon 16. This eliminates the ribbon supply torque mechanisms or user adjustments of the prior art thermal printers.

Specific embodiments of a thermal ribbon cartridge or roll according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

I claim:

1. A consumable web roll, comprising:

a hollow core configured to receive a length of consumable web wound on an outer surface thereof; and a resilient structure received within the hollow core and radially engaging an inner surface thereof, said resilient structure storing torsional energy and serving as a friction clutch when the consumable web is advanced and the core rotated, and retracting the consumable web when the consumable web is released or backfed.

2. The consumable web roll defined by claim 1 wherein said resilient structure comprises an elastomer.

3. The consumable web roll defined by claim 2 wherein said elastomer is flat and comprises a center section configured to engage said inner surface of said hollow core with an interference fit.

4. The consumable web roll defined by claim 2 wherein said elastomer is flat and comprises an end section configured to be held by an external constraint.

5. A printer comprising:

a print head, a print platen, and a consumable web cartridge locator, said printer defining a feed path for a consumable web from a consumable web cartridge locator to said print head; and a consumable web cartridge adapted to be received by said consumable web cartridge locator and having clutching and slack take-up capability, the consumable web cartridge including:

a rotatably supported hollow core configured to receive a length of consumable web wound on an outer surface thereof; and a resilient structure held at an end thereof and received within the hollow core to radially engage an inner surface thereof, said resilient structure storing torsional energy and serving as a friction clutch when the consumable web is advanced and the core is rotated, and retracting the consumable web when the consumable web is released or backfed.

6. The printer defined by claim 5 including a support independent of said resilient structure and configured to support the weight of said resilient structure.

7. The printer defined by claim 5 including a constraint for holding said end of the resilient structure.

8. The printer defined by claim 5 wherein said resilient structure comprises an elastomer.

9. The printer defined by claim 8 wherein said elastomer is flat and comprises a center section configured to engage said inner surface of said core with an interference fit.

10. The printer defined by claim 8 wherein said elastomer is flat and comprises an end section adapted to fit an external key.

11. The printer defined by claim 5 wherein said roll of consumable web is adapted to be rotatably supported on a shaft.

12. A consumable web roll with slack take-up capability, comprising:

a rotatably supported hollow core adapted to receive a length of consumable web wound on an outer surface thereof; and a resilient structure held at an end thereof and extending into the core to radially engage an inner surface thereof;

the resilient structure storing torsional energy when the consumable web is advanced and retracting the consumable web when the consumable web is released or backfed.

13. A printer compring:

a print head, a print platen, and a consumable web cartridge locator, said printer defining a feed path for a consumable web from said consumable web cartridge locator to said print head; and a consumable web cartridge adapted to be received by said consumable web cartridge locator and having slack take-up capability, said consumable web cartridge comprising:

a housing;

within said housing a rotatably supported hollow core configured to receive a length of consumable web wound on an outer surface thereof; and a resilient structure held at an end and extending into the core to frictionally engage an inner surface thereof, the resilient structure storing torsional energy when the consumable web is advanced and retracting the consumable web when the consumable web is released or backfed.

14. A printer comprising:

a print head, a print platen, and a consumable web roll locator, said printer defining a feed path for consumable web from said consumable web roll locator to said print head;

a consumable web roll with slack take-up capability adapted to be received by said consumable web locator and including:

a rotatably supported hollow core adapted to receive a length of consumable web wound on an outer surface thereof; and a resilient structure held at an end thereof and extending into the core to radially engage an inner surface thereof, the resilient structure storing torsional energy when the consumable web is advanced and retracting the consumable web when the consumable web is released or backfed.

* * * * *